US005966834A

United States Patent [19]

Steiner et al.

[11] Patent Number: 5,966,834

[45] Date of Patent: Oct. 19, 1999

[54] MACHINE AND METHOD FOR PRODUCING A MATERIAL WEB

[75] Inventors: Karl Steiner, Herbrechtingen; Tri Chau-Huu, Heidenheim, both of Germany

[73] Assignee: Voith Sulzer Papiermaschinen GmbH, Heidenheim, Germany

[21] Appl. No.: 08/839,780

[22] Filed: Apr. 15, 1997

[30] Foreign Application Priority Data

Apr. 16, 1996 [DE] Germany ..... 196 14 887

[51] Int. Cl.[6] ..... D06F 58/00

[52] U.S. Cl. ..... 34/116; 36/114; 36/71; 36/95; 36/355; 162/358

[58] Field of Search ..... 34/114, 115, 116, 34/117, 118, 392, 71, 95; 162/358, 359

[56] References Cited

U.S. PATENT DOCUMENTS 4,162,190 7/1979 Ashworth ..... 162/359

5,594,997 1/1997 Lehtinen ..... 34/95

*Primary Examiner*—Henry Bennett
*Assistant Examiner*—Pamela A. Wilson
*Attorney, Agent, or Firm*—Greenblum & Bernstein, P.L.C.

[57] ABSTRACT

A machine and method for producing a material web, e.g., a paper or cardboard web. The machine includes a dryer group having a plurality of dryer cylinders and web guide rolls. A dryer (or guide) belt may guide the material web around the dryer cylinders and web guide rolls in a meandering or winding path. The dryer group may include a cooling device that cools the dryer belt by exerting an air current on the dryer belt after separation from the material web. The method may include drying the material web in a region of the dryer group in which the material web is held and guided between the dryer belt and each drying cylinder, and substantially preventing drying of the material web in a region of the dryer group in which the material web is transferred from one drying cylinder onto a subsequent one.

25 Claims, 2 Drawing Sheets

MACHINE AND METHOD FOR PRODUCING A MATERIAL WEB

CROSS-REFERENCE OF RELATED APPLICATION

The present invention claims the priority under 35 U.S.C. §119 of German Patent Application No. 196 14 887.1 filed on Apr. 16, 1996, the disclosure of which is expressly incorporated by reference herein in its entirety.

BACKGROUND OF THE INVENTION

1. Field of the Invention

The present invention relates to a machine for producing a material web, e.g., a paper or cardboard web, including a dryer group having a plurality of dryer cylinders and web guide rolls. A dryer or guide belt may guide the material web around the dryer cylinders and web guide rolls in a meandering or winding path. The dryer group may include a cooling device that cools the dryer belt by exerting an air current on the dryer belt after separation from the material web.

The present invention also relates to a process for producing a material web, e.g., a paper or cardboard web, in which the material web may be dried in a region of a dryer group in which the material web is held and guided between the dryer belt and each drying cylinder, and that drying of the material web may be substantially prevented in a region of the dryer group in which the material web is transferred from one drying cylinder onto a subsequent one.

2. Discussion of Background Information

Machines and processes of the type generally described above have been disclosed, e.g., in U.S. Pat. No. 4,625,430. A material web alternatingly runs around heated dryer cylinders and water-cooled web guide rolls. When the material web runs around a dryer cylinder, the web is clamped between the surface of the dryer cylinder and the dryer belt and when the material web runs around the cooled web guide roll, the web guided on the outside of a dryer belt, i.e., the dryer belt is positioned between the material web and the cooled web guide roll.

When the material web is held on the dryer cylinder by the dryer belt, the side of the web adjacent the dryer cylinder is heated and its opposite side is cooled by the dryer belt. The material web is dried by means of the temperature difference that occurs between the dryer cylinder and the dryer belt. To maintain the desired temperature difference inside the dryer group, the dryer (or guide) belt, which is heated continuously by the dryer cylinder through the material web, is cooled when the guide belt runs around the web guide rolls. The web guide roll is cooled on its interior by a cooling water current. However, this manner of cooling the guide belt has a correspondingly costly construction. As a result, the cost of the machine for producing the material web in the above-described manner is relatively high, as is its operating cost. Further, the specific drying rate of above-mentioned dryer groups may be improved.

SUMMARY OF THE INVENTION

An object of the present invention is to produce a machine and a process of the above-mentioned type which does not suffer from the same or similar disadvantages.

The present invention may be directed to a machine for producing a material web, e.g., a paper or cardboard web. The machine may include a drier group including a plurality of dryer cylinders and web guide rolls and a dryer belt guide the material web around the dryer cylinders and web guide rolls. The dryer group may include a cooling device that cools the dryer belt, e.g., by exerting an air current on the dryer belt, at a location in the dryer group in which the dryer belt is separated from the material web. Because the dryer belt may be acted upon with a gaseous medium, e.g., air, in a region of the dryer group in which the dryer belt is not in contact with any of the material web, a drying cylinder, and a web guide roller, cooling of the dryer belt may occur quite easily, particularly without negatively influencing the quality of the material web. Further, by utilizing air aspirated from the dryer group surroundings to cool the dryer belt, the cooling device may be very simply constructed. Thus, in contrast to the cooling device of the prior art, which uses a fluid coolant, the closed, sealed, and, consequently, costly line circuits may be eliminated. Because the air utilized as cooling medium may be taken from the dryer group surroundings, the operating costs of the machine of the present invention may be reduced considerably.

An exemplary embodiment of the machine of the present invention may include at least one dryer group arranged as a two-row dryer group, i.e., two rows of dryer cylinders. The center points of each dryer cylinder in each respective row may be positioned to form two spaced apart planes. Between each row of dryer cylinders, a transfer region may be formed in which the material web runs in a free draw. Each row of dryer cylinders may be associated with its own dryer or guide belt guided around each dryer cylinder and guide rolls in a closed loop. Because the material web runs through the transfer region in a free draw, there is no dryer or guide belt to support the material web, and more importantly, to restrict web shrinkage. To substantially prevent shrinkage, moisture in the air of the tranfer region, in accordance with the present invention, may be maintained in approximate equilibrium with the moisture of the material web.

Because the air moisture in the transfer region may be adjusted to align with the web moisture, shrinkage of the material web, particularly in the a direction lateral to the direction of web travel, may be substantially prevented in the free draw of the transfer region. Accordingly, drying of the material web may be substantially limited to the region of the dryer group in which the material web rests against or abuts each dryer cylinder, i.e., in which the dryer belt holds the material web against the dryer cylinder. As a result of the above-described arrangement, a temperature difference may be built up and maintained between the dryer cylinder and the dryer belt, through the material web. The temperature difference causes the moisture to leave the material web, thus, resulting in a drying of the material web. Since the dryer belt, which may be prestressed, e.g., at 2 to 4 kN/m, presses and holds the material web against each associated dryer cylinder, the material web may be substantially prevented from shrinking. Thus, the material web may have substantially identical properties over its entire width, thus, increasing quality.

In another exemplary embodiment of the machine of the present invention, the dryer belt may be cooled prior to being fed onto the first dryer cylinder of a dryer group and/or may be cooled within a dryer group. Because of the heat transferred from the dryer cylinder to the guide belt through the material web, the guide belt may heat up as it passes through the dryer group, which reduces the temperature difference exerted upon the material web. Thus, it may be preferred to cool down the guide belt before it is fed back into the dryer group. However, if the transfer of heat to the guide belt is particularly high or if the dryer group utilizes a particularly large number of drying cylinders within the dryer group, it may be preferred to cool down the guide belt at an intermediate point within the dryer group. This arrangement may increase the drying gradient of the material web guided through the dryer group.

Further, another alternative exemplary embodiment of the machine of the present invention is that the guide belt may be cooled by at least one suction device and/or at least one blower device. That is, a flow of cooling air acting upon the guide belt may dissipate the heat absorbed by the guide belt and may remove the moisture condensed on the guide belt.

In accordance with another alternative embodiment of the present invention, a side of the guide belt oriented toward the material web may be more hydrophobic than the side away from the material web. Accordingly, the side of the guide belt away from the material web may be hydrophilic while the side of the guide belt contacting the material web may be embodied as moisture repellent. The hydrophilic surface, e.g., similar to a sponge, may be comprised of a hygroscopic material. Thus, the guide belt of this embodiment may provide an accelerated removal of moisture left behind by the material web. Accordingly, impaired heat dissipation from the material web, e.g., due to a formation of a layer of moisture that may have an insulating effect, may be substantially eliminated, thereby improving the specific drying rate of the dryer section.

The above-mentioned object may also be attained by the disclosed process for producing the material web with the above-described machine. In accordance with the process of the present invention, the process may include drying the material web within the region of the dryer group in which the material web it held and guided between the guide belt and the drying cylinder, and substantially preventing drying in the region of the dryer group in which the material web is transferred from one dryer cylinder to a subsequent dryer cylinder. Because of the features of the process of the present invention, a favorable drying rate may be produced, and undesirable shrinkage of the material web, which may impair certain web properties, may be substantially prevented.

Accordingly, the present invention may be directed to a machine for producing a material web. The machine may include at least one dryer group having a plurality of dryer cylinders and a plurality of web guide rolls, a dryer belt guiding the material web around a portion of the at least one dryer group, a belt cooling section receiving the dryer belt separated from the material web, and a cooling device located within the belt cooling section to exert an air current on the dryer belt.

In accordance with another feature of the present invention, the at least one dryer group may include a two-row dryer group having a first and second group. The first group may include a first predetermined number of the plurality of dryer cylinders arranged so that a center point of each of the first predetermined number of dryer cylinders forms a first plane and the second group may include a second predetermined number of the plurality of dryer cylinders arranged so that a center point of each of the second predetermined number of dryer cylinders forms a second plane. The dryer belt may be associated with the first group to guide the material web around a portion of the first predetermined number of dryer cylinders and a second dryer belt may be associated with the second group to guide the material web around a portion of the second predetermined number of dryer cylinders. A transfer region may be formed between the first and second plane and the material web may pass through the transfer region in a free draw. The transfer region may include an air moisture content approximately at equilibrium with a moisture content of the material web passing through the transfer region.

In accordance with another feature of the present invention, the belt cooling section may be located at least at one of before the dryer belt is fed onto a first drying cylinder of a drier group and inside at least one of the at least one dryer group.

In accordance with still another feature of the present invention, the cooling device may include at least one of at least one suction device and at least one blower device.

In accordance with yet another feature of the present invention, the dryer belt may include a porous material enabling the air current to flow from a first side for carrying the material web to a second side opposite the first side.

In accordance with a further feature of the present invention, the dryer belt may have a first side to be oriented toward the material web, and the first side may be more hydrophobic than a second side located opposite the first side. Further, the second side of the dryer belt may include a hydrophilic material.

The present invention may also be directed to a process for producing a material web in a machine. The machine may include a dryer group including a plurality of dryer cylinders and a plurality of web guide rolls, the material web may be guided in a winding path by a dryer belt around the dryer cylinders and web guide rolls, and a cooling device may cool the dryer belt. The method may include drying the material web in a first region of the dryer group in which the material web is guided and held between the dryer belt and each of the plurality of dryer cylinders and substantially preventing drying of the material web in a second region in which the material web is transferred from one drying cylinder onto a subsequent one.

In accordance with another feature of the present invention, the method may also include maintaining a moisture content in the second region substantially similar to a moisture content of the material web.

The present invention may also be directed to a dryer group for a material web producing machine. The dryer group may include a first subgroup including a first plurality of dryer cylinders and a first plurality of deflections rolls, a first dryer belt associated with the first subgroup that guides the material web around at least a portion of each of the first plurality of dryer cylinders and the first plurality of deflection rolls, a first dryer belt cooler positioned such that the first dryer belt is guided past the first dryer belt cooler after a separation from the material web, and a transfer region adjacent the first subgroup substantially restricting drying of the material web passing therethrough.

In accordance with another feature of the present invention, the dryer group may also include a second subgroup comprising a second plurality of dryer cylinders and a second plurality of deflection rolls and a second dryer belt associated with the second subgroup that guides the material web around at least a portion of each of the second plurality of dryer cylinder and the second plurality of deflection rolls. The transfer region may be positioned between the first subgroup and the second subgroup. Further, the material web may be alternatingly guided around dryer cylinders of the first subgroup and dryer cylinders of the second group. Still further, the material web may pass through the transfer region in free draw.

In accordance with a further feature of the present invention, the second dryer belt cooler may include a blower box to force air through the second dryer belt to remove moisture from a material web carrying side of the second dryer belt and into an interior portion of the second subgroup. Further, the dryer group may include an aspirating device for removing the air and moisture from the interior portion of the second subgroup.

In accordance with a further feature of the present invention, the first dryer belt cooler may be located on a return portion of the first dryer belt between an end of the first subgroup and a beginning of the first subgroup and may include a suction box that suctions moisture through the first dryer belt from a side that carries the material web to an opposite side.

In accordance with another feature of the present invention, the first dryer belt cooler may be located within the first subgroup and additional deflection rolls may divert the first dryer belt away from at least a predetermined one of the dryer cylinders of the first subgroup and to the first dryer belt cooler. Further, the first dryer belt cooler may include a suction box and a blower box arranged opposite each other with the dryer belt running therebetween. The first dryer belt cooler may be arranged to remove moisture from the dryer belt from a material web carrying side to an opposite side.

The present invention may also be directed to a method for drying a material web within a dryer group of a web producing machine. The dryer group may include a first and second subgroup, where each subgroup may include a plurality of dryer cylinders and an associated dryer belt that guides the material web around the plurality of dryer cylinders within the associated subgroup. The dryer group may also include a tranfer region located between the first and second subgroup. The method may include guiding the material web, in free draw, alternatingly between dryer cylinders of the first subgroup and dryer cylinders of the second subgroup, substantially preventing drying of the material web as the material web is guided between the first and second subgroups, drying the dryer belt associated with the first subgroup by forcing air through the dryer belt, and drying the dryer belt associated with the second subgroup by forcing air through the dryer belt.

In accordance with another feature of the present invention, substantially preventing drying may include maintaining a moisture content within the transfer region to substantially similar to the moisture content of the material web within the transfer region.

In accordance with a further feature of the present invention, drying the dryer belt associated with the first subgroup may include locating a suction box adjacent a return portion of the dryer belt between an end of the first subgroup and a beginning of the first subgroup, guiding the dryer belt of the first subgroup through a suction region of the suction box, and drawing moisture through the dryer belt of the first subgroup from a material web contacting side to an opposite side.

In accordance with a still further feature of the present invention, drying the dryer belt associated with the second subgroup may include locating a blower box adjacent a return portion of the dryer belt between an end of the second subgroup and a beginning of the second subgroup, guiding the dryer belt of the second subgroup through a blower region of the blower box, and forcing moisture through the dryer belt of the second subgroup from a material web contacting side to an opposite side. Further, forcing moisture may include directing the air and moisture into an interior portion of the second subgroup, and aspirating the directed air and moisture from the interior portion of the second subgroup.

In accordance with yet another feature of the present invention, drying the dryer belt associated with the first subgroup may include locating a belt drying device within the first subgroup, diverting the dryer belt associated with the first subgroup away from a predetermined dryer cylinder of the first subgroup to a position within the first subgroup, guiding the dryer belt of the first subgroup to the belt drying device, and removing moisture from dryer belt of the first subgroup from a material web contacting side to an opposite side. Further, the belt drying device may include a blower box and a suction box such that the method may further include guiding the dryer belt between the blower box and the suction box, and concurrently forcing air through the dryer belt and suctioning air through the dryer belt.

Further embodiments and advantages can be seen from the detailed description of the present invention and the accompanying figures.

BRIEF DESCRIPTION OF DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PREFERRED EMBODIMENTS

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

The present invention, as described below, may be practiced in a machine for producing a material web. Accordingly, while the present invention is discussed in terms of its preferred embodiment in a paper making machine, this disclosure is not intended to be limiting, but, rather, intended for substantially universal use in other similar type devices.

Figure 1:
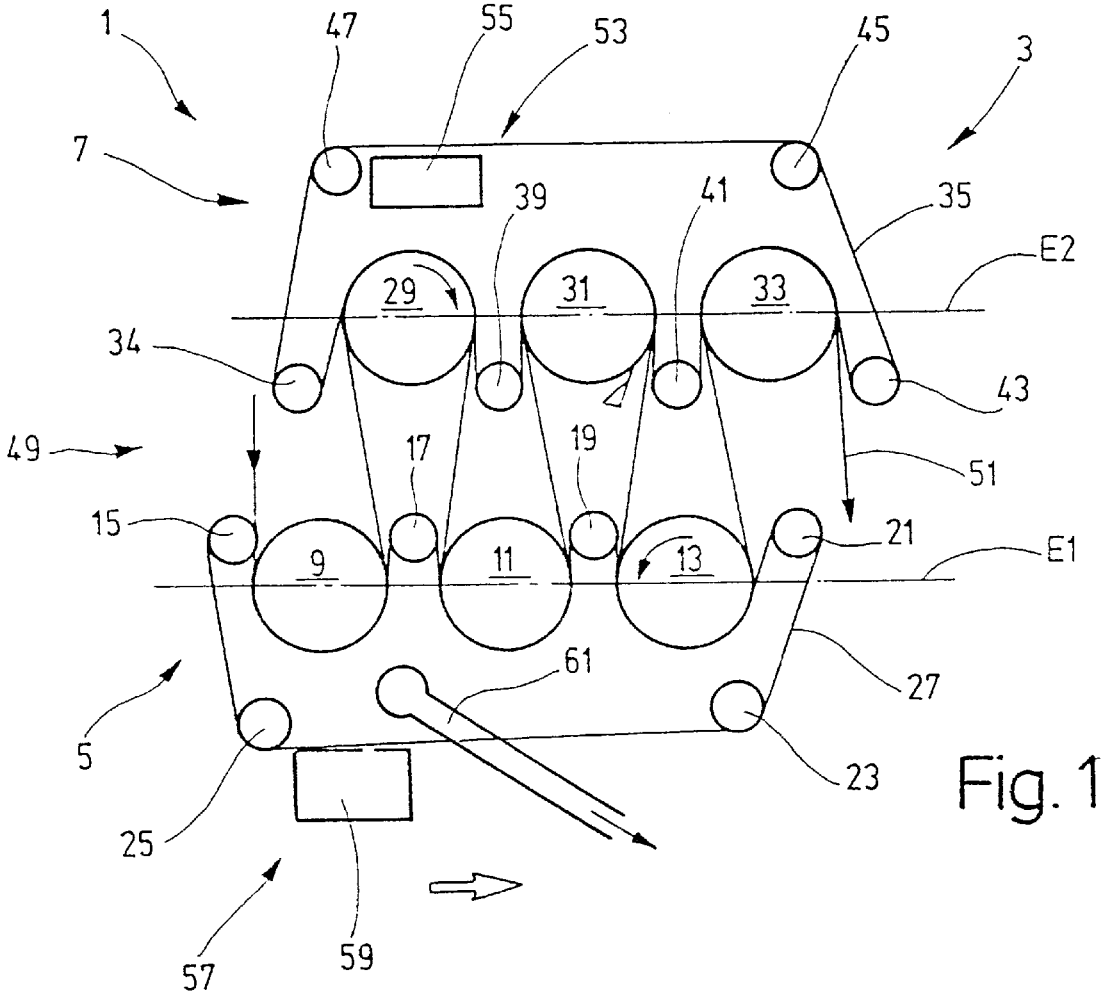
FIG. 1 illustrates a side view of a portion of a dryer group in a machine for producing a material web.

FIG. 1 illustrates, e.g., a dryer group 3 positioned within a dryer section of a paper making machine 1. Dryer group 3 may include two subgroups, e.g., first (lower) subgroup 5 and second (upper) subgroup 7. First subgroup 5 may include dryer cylinders 9, 11, and 13, arranged such that the center points of each dryer cylinder disposed within an imaginary plane E1. Dryer cylinders 9, 11, and 13 may also be spaced apart from one another and may be arranged in a row to form, e.g., a single-row subgroup. Subgroup 5 may also include a plurality of deflection (web guide) rolls 15, 17, 19, 21, 23, and 25 and an endless or closed loop dryer (or guide) belt 27. Dryer belt 27 may be arranged to be guided around each of the dryer cylinders and deflection rolls in a winding (or meandering) path. Thus, as shown in FIG. 1, endless dryer belt 27 may partially enclose dryer cylinders 9, 11, and 13.

Drying cylinders 29, 31, and 33 may be utilized within second subgroup 7, and arranged such that their center points may be arranged within a plane E2. Plane E2 may be spaced from plane E1. Drying cylinders 29, 31, and 33 of subgroup 7 may also be located adjacent to each another to form a second one-row subgroup. A dryer belt 35 may be partially guided around dryer cylinders 29, 31, and 33 via deflection (web guide) rolls 37, 39, 41, 43, 45, and 47. As shown in FIG. 1, the two subgroups may be combined into a two-row drier group.

A transfer region 49 may be formed between first subgroup 5 and second subgroup 7. Within tranfer region 49, a material web 51 may be transferred between the two subgroups. Material web 51 may travel through dryer group 3, e.g., left to right, as shown by the arrows on material web 51. Material web 51 may be alternatingly guided around the drying cylinders of first subgroup 5 and second subgroup 7. After running off one dryer cylinder, e.g., a dryer cylinder from the first dryer subgroup, material web 51 may travel in a free draw through transfer region 49 and feeds onto a dryer cylinder of the second dryer subgroup. As a result, material web 51 may be arranged to enclose pocket-like spaces within transfer region 49 containing a relatively high air moisture content, due to the moisture entrained with the material web, which is in approximate equilibrium with the moisture of the material web. If necessary, special devices may also be utilized to adjust the moisture in the pockets.

A first cooling device 53 may be located inside the closed loop formed by dryer belt 35 of upper subgroup 7. Cooling device 53 may include a suction box 55 extending laterally across a width of paper making machine 1 and may act upon dryer belt 35 with a cooling air current, e.g., dry air. The dryer belt 27 of lower subgroup 5 may be associated with a cooling device 57. Cooling device 57 may include a blow box 59 that may act upon an entire width of dryer belt 27 with, e.g., dry air. Blow box 59 may be located outside the closed loop formed by dryer belt 27. In the embodiment depicted in FIG. 1, the air current emitting from blow box 59 may be substantially directed toward dryer cylinders 9, 11, and 13. The blown air current may penetrate dryer belt 27 and pass into the space formed within the closed loop of dryer belt 27. A suction conduit 61 may also be located within this space as a part of a suction device (not shown) to remove the air currents passing through dryer belt 27. As dryer belt 27 reaches the end of lower subgroup 5, deflection rolls 21, 23, 25, and 15, as discussed above, may direct dryer belt 27 back to the beginning of lower subgroup 5. The moist dryer belt is guided past the relatively cool and dry air currents expelled from blow box 59. The cooling air currents pass through the porous dryer belt and remove heat and condensate deposited on dryer belt 27 in the form of vapor. The heated, moist air current within the closed loop, i.e., the air currents from blower 59 passing through the dryer belt, may be aspirated by suction conduit 61. In addition to, or in lieu of, suction conduit 61, at least one of deflection rolls 15, 17, 19, 21, 23, and 25 may be formed as a suction conducting roll to remove the humid air in the space enclosed by the dryer belt 27.

In accordance with a preferred embodiment of the present invention, material web 51 may be fed with dryer belt 27 around a portion of first dryer cylinder 9 of subgroup 5 of dryer group 3. Because dryer belt 27 is cooler than either material web 51 or a surface of first dryer cylinder 9, dryer belt 27 withdraws heat and moisture from material web 51. When material web 51 and dryer belt 27 roll off first drying cylinder 9 and separate, dryer belt 27 may be guided by deflection roll 17 onto subsequent drying cylinder 11 of subgroup 5 and material web 51 passes through transfer region 49 in a free draw to be guided around a portion of first dryer cylinder 29 of subgroup 7 by dryer belt 35. At subsequent dryer cylinder 11, material web 51, which has passed through transfer region 49 in a free draw, may be guided around a portion of subsequent dryer cylinder 11 by dryer belt 27. The material web continues to pass through dryer group 3 in this manner until it is separated from dryer belt 35 at the end of the dryer group, e.g., dryer cylinder 33, and directed to a subsequent treatment facility of the machine.

Because the air contained within transfer region 49 is maintained to exhibit substantially a same moisture as that contained in material web 51, material web 51 cannot eliminate any contained moisture when passing through transfer region 49. However, as material web 51 is guided around each dryer cylinder, the heated surface of the dryer cylinder in contact with the material web 51 causes the material web 51 to emit or give off heat and moisture to the associated dryer belt. Accordingly, the dryer belt is heated and moistened in increasing amounts as the dryer belt passes through dryer group 3. Thus, as dryer belt continues around each dryer cylinder, the amount of heat and moisture contained within the dryer belt accumulates.

The temperature of dryer belts 27 and 35 increases as each dryer belt is guided around subsequent dryer cylinders, and, at the end of each respective subgroup, the temperature of each dryer belt may be, e.g., 70° C. Dryer belts 27 and 35, therefore, may be guided past respective cooling devices 59 and 55, located near the start of each subgroup, by the deflection rolls. For example, air may be blown onto, and through, dryer belt 27 to remove the entrained heat and moisture. The temperature of dryer belt 27 may be reduced by less than approximately 30° K., and preferably reduced by approximately 20° K. The cooled dryer belt 27 may then be guided to the first dryer cylinder 9 by deflection roll 15. Dryer belt 35, guided back toward a start of the subgroup, may be aspirated by suction box 55. The air aspirated from the surroundings likewise removes heat and moisture from dryer belt 35. Accordingly, The temperature of dryer belt 35 may also be reduced by less than approximately 30° K., and preferably reduced by approximately 20° K.

Because air moisture contained within the region of the free draw, i.e., transfer region 49, is maintained to correspond with the moisture of material web 51, the drying process of material web 51 may be interrupted within tranfer region 49. Thus, because drying of material web 51 may be substantially restricted to when material web 51 is held between a drying cylinder and the associated dryer belt, the present invention substantially eliminates drying and shrinkage of material web 51 within transfer region 49. Accordingly, material web 51 may exhibit substantially similar properties over its entire width, thus, increasing the quality of the material web. Further, costly devices, necessary in the prior art to clamp and hold the material web in the region of free draws to prevent shrinkage, are not required by the present invention.

Figure 2:
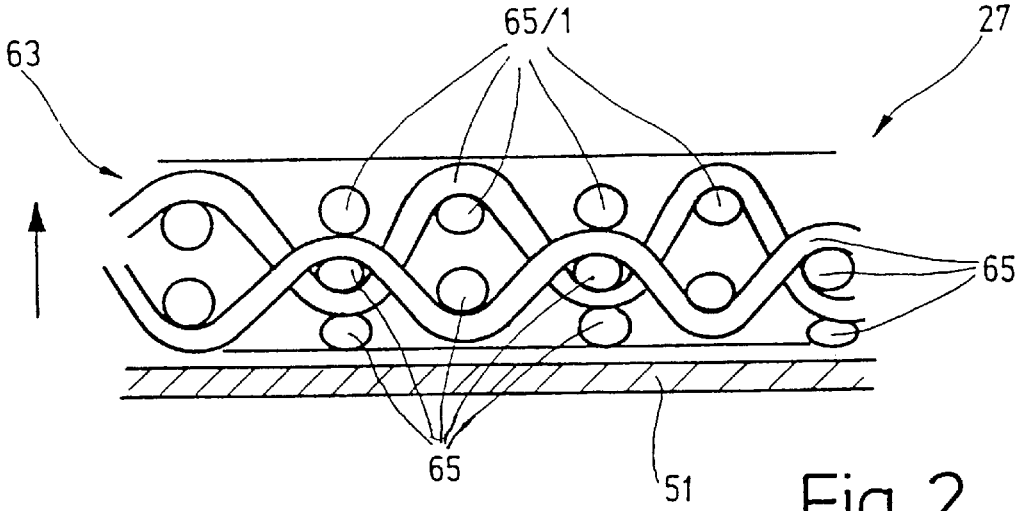
FIG. 2 illustrates a schematic sectional view of a dryer or guide belt in accordance with the present invention.

FIG. 2 illustrates a substantially enlarged side view of dryer belt 27 guiding material web 51 in accordance with the present invention. In this instance, dryer belt 27 may have a cloth-like structure produced by individual strands 63 woven together. A side of dryer belt 27, i.e., oriented toward (and contacting) material web 51, or the strand-shaped fibers 65 adjoining material web 51 may comprise a material exhibiting hydrophobic properties, i.e., water repellent. Fibers 65/1 located on an opposite side of dryer belt 27, i.e., remote from material web 51, may comprise a hydrophilic material exerting an attractive effect on the moisture and preferably absorbing it. The moisture emerging from material web 51 may be transmitted through dryer belt 27 in direction of a decrease in heat, i.e., from the hydrophobic surface to the hydrophilic surface (as shown by the arrow at the left margin of the figure). The deposited condensate, e.g., droplets of liquid, on dryer belt 27 may be repelled by the hydrophobic fibers 65 and forced toward the hydrophilic side dryer belt 27. Hydrophilic fibers 65/1 complement or intensify the force of the hydrophobic surface by attracting the condensate to some extent. Consequently, substantially immediately after emerging from material web 51, the moisture is conveyed out of the contact region, i.e., between the material web and the dryer belt, which substantially eliminates the formation of a heat-insulation vapor layer and/or a fluid layer in the contact region. This considerably improves the drying of material web 51.

A dryer belt having the above-mentioned properties may also have the advantage that, since the moisture is collected or absorbed on the hydrophilic material side of the dryer belt, the moisture may be more easily removed from the hydrophilic dryer belt surface. Dryer belt 27 may be guided by blow box 59 of cooling device 57 such that the hydrophobic side of the dryer belt is oriented toward blow box 59. In this arrangement, the air currents coming out of blow box 59 may remove the moisture held in dryer belt 27. For example, the air currents further direct the moisture from the hydrophobic side to the hydrophilic side of dryer belt 27. Further, because the moisture is being collected on the hydrophilic side prior to being guided past blower box 59, the moisture does not have to be forced through the entire dryer belt by the air currents. Dryer belt 27 may simultaneously be cleaned by the air currents from blower box 59, thus, eliminating the need for conventional dryer belt cleaning devices of the prior art. Dryer belt 35 of subgroup 7 may be designed similarly, i.e., to include a hydrophobic side and a hydrophilic side, to dryer belt 27, as shown in FIG. 2. However, because cooling device 57 of dryer belt 35 comprises a suction box 55, dryer belt 35 may be guided by suction box 55 with its hydrophilic side oriented toward the suction box. In this manner, moisture removal may be facilitated because the moisture will have been collected on the side facing the suction box.

Figure 3:
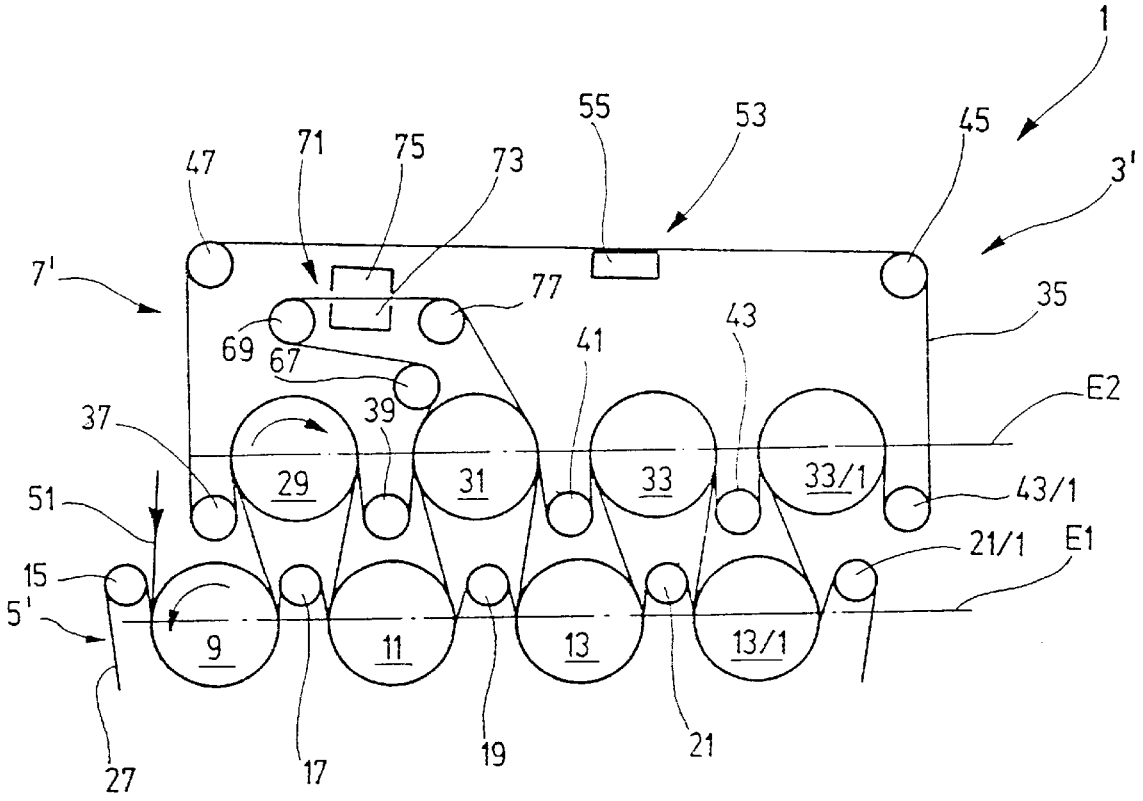
FIG. 3 illustrates a schematic, partial view of a dryer group in accordance with an alternative embodiment of the present invention.

FIG. 3 illustrates a schematic side view of an alternative exemplary embodiment of paper making machine 1. Elements similar to those discussed with respect to FIG. 1 will be correspondingly numbered in FIG. 3.

FIG. 3 illustrates a subgroup 5' of a dryer group 3' which differs from lower subgroup 5 (shown in FIG. 1) by including an additional dryer cylinder 13/1 and an additional deflection roll 21/1 located at the end of subgroup 5'. As with the embodiment shown in FIG. 1, dryer belt 27 of the subgroup 5' may be associated with a cooling device (not shown) in the region in which dryer belt 27 may be guided from the end of subgroup 5' back to the beginning.

The alternative embodiment also shows a subgroup 7' of dryer group 3' including an additional dryer cylinder 33/1 and an additional deflection roll 43/1. In the vicinity of dryer cylinder 31, i.e. inside subgroup 7', dryer belt 35 may be lifted from dryer cylinder 31 and guided via deflection rolls 67 and 69 to a cooling device 71 containing a suction box 73 and a blow box 75. Meanwhile, material web 51 remains in an abutting arrangement with dryer cylinder 31, and may be, therefore, guided by the dryer cylinder. Suction box 73 and blow box 75 may be located on opposite sides of dryer belt 35. The current of air coming out of blow box 75 may penetrate dryer belt 35, cool down the dryer belt, and remove moisture absorbed by the hydrophilic side. Suction box 73 may be oriented toward blow box 75 such that the moist current of air coming through dryer belt 35 may be immediately aspirated and removed from the interior portion of subgroup 7'. After leaving cooling device 71, dryer belt 35 may be guided over a portion of dryer cylinder 31 by a deflection roll 77. The cooling of dryer belt 35 from inside subgroup 7' may be also be provided, e.g., if there is increased moisture to be removed from material web 51 or if the dryer group is comprised of a single row.

The cooling devices, i.e., suction boxes and blow boxes, may utilize a pressure differential at each respective box of, e.g., less than approximately 0.1 bar and approximately 0.002 bar.

Dryer belts 27 and 35 may have a high specific heat capacity. Therefore, in accordance with the features of the present invention, the dryer belts may also have an increased heat absorption capacity.

The air quantity supplied to the blower boxes or removed by the suction boxes may be controlled in accordance with the temperature and/or moisture of the dryer belts. Further, the air quantity may be preferably constant across the width of the material web.

With the use of a blower box for cooling a dryer belt, the cross direction profile of the material web may be influenced in a simple manner, e.g., by dividing the blower box into individual segments disposed spaced apart from, and adjacent to, one another over the width of the machine. Each individual segment may have separately controlled lines for coupling an air supply to each segment. Further, respective cooling air currents may be regulated so that the dryer belt may be cooled down differently over its width. Consequently, the removal of moisture from the material web may be different over its width. Further, a cooling device may include a plurality of blower boxes connected in series to supply air having different moisture contents to the dryer belt to influence the cross direction profile of the material web.

Cooling devices of the type generally described above for dryer belts may be universally employed for all embodiments of dryer sections, e.g., single-row, two-row dryer sections, and tower dryer sections.

The machine depicted in FIGS. 1–3 may be provided with lateral limiting walls. While such walls have not been shown in the figures for the sake of clarity, these walls may be utilized to prevent a lateral supply and removal of air and moisture. In this way, pressure and moisture ratios within machine 1 may be adjusted in a definite manner.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed is:

1. Apparatus for producing a material web comprising:

at least one dryer group comprising a plurality of dryer cylinders and a plurality of web guide rolls;

a dryer belt guiding the material web around a portion of the at least one dryer group;

a belt cooling section receiving the dryer belt separated from the material web; and a cooling device located within the belt cooling section to exert an air current on the dryer belt, wherein the belt cooling section is located before the dryer belt is fed into a first drying cylinder of a drier group.

2. The apparatus according to claim 1, the at least one dryer group comprising a two-row dryer group having a first and second group;

the first group including a first predetermined number of the plurality of dryer cylinders arranged such that a center point of each of the first predetermined number of dryer cylinders forms a first plane;

the second group including a second predetermined number of the plurality of dryer cylinders arranged such that a center point of each of the second predetermined number of dryer cylinders forms a second plane;

the dryer belt associated with the first group to guide the material web around a portion of the first predetermined number of dryer cylinders;

a second dryer belt associated with the second group to guide the material web around a portion of the second predetermined number of dryer cylinders;

a transfer region formed between the first and second plane;

the material web passing through the transfer region in a free draw; and the transfer region comprising an air moisture content approximately at equilibrium with a moisture content of the material web passing through the transfer region.

3. The apparatus according to claim 1, further comprising a second belt cooling section located inside the at least one dryer group.

4. The apparatus according to claim 1, the cooling device comprising at least one of at least one suction device and at least one blower device.

5. The apparatus according to claim 1, the dryer belt comprising a porous material enabling the air current to flow from a first side for carrying the material web to a second side opposite the first side.

6. The apparatus according to claim 1, the dryer belt having a first side to be oriented toward the material web, the first side being more hydrophobic than a second side located opposite the first side.

7. The apparatus according to claim 6, the second side of the dryer belt comprising a hydrophilic material.

8. A process for producing a material web in a machine having a dryer group including a plurality of dryer cylinders and a plurality of web guide rolls, the material web being guided in a winding path by a dryer belt around the dryer cylinders and web guide rolls, and including a cooling device that cools the dryer belt, the process comprising:

drying the material web in a region of the dryer group in which the material web is guided and held between the dryer belt and each of the plurality of dryer cylinders; and substantially preventing drying of the material web in a transfer region in which the material web is transferred from one drying cylinder onto a subsequent one.

9. The process according to claim 8, maintaining a moisture content in the transfer region substantially similar to a moisture content of the material web.

10. A dryer group for a material web producing machine comprising:

a first subgroup comprising a first plurality of dryer cylinders and a first plurality of deflection rolls;

a first dryer belt associated with the first subgroup that guides the material web around at least a portion of each of the first plurality of dryer cylinders and the first plurality of deflection rolls;

a first dryer belt cooler positioned such that the first dryer belt is guided past the first dryer belt cooler after a separation from the material web; and a transfer region adjacent the first subgroup substantially restricting drying of the material web passing therethrough.

11. The dryer group according to claim 10, further comprising:

a second subgroup comprising a second plurality of dryer cylinders and a second plurality of deflection rolls;

a second dryer belt associated with the second subgroup that guides the material web around at least a portion of each of the second plurality of dryer cylinder and the second plurality of deflection rolls; and the transfer region positioned between the first subgroup and the second subgroup.

12. The dryer group according to claim 11, the material web alternatingly guided around dryer cylinders of the first subgroup and dryer cylinders of the second group.

13. The dryer group according to claim 11, the material web passing through the transfer region in free draw.

14. The dryer group according to claim 11, the second dryer belt cooler comprising a blower box to force air through the second dryer belt to remove moisture from a material web carrying side of the second dryer belt and into an interior portion of the second subgroup.

15. The dryer group according to claim 14, further comprising an aspirating device for removing the air and moisture from the interior portion of the second subgroup.

16. The dryer group according to claim 10, the first dryer belt cooler, located on a return portion of the first dryer belt between an end of the first subgroup and a beginning of the first subgroup, comprising a suction box that suctions moisture through the first dryer belt from a side that carries the material web to an opposite side.

17. The dryer group according to claim 10, the first dryer belt cooler, located within the first subgroup; and additional deflection rolls divert the first dryer belt away from at least a predetermined one of the dryer cylinders of the first subgroup and to the first dryer belt cooler.

18. The dryer group according to claim 17, the first dryer belt cooler comprising a suction box and a blower box arranged opposite each other with the dryer belt running therebetween; and the first dryer belt cooler arranged to remove moisture from the dryer belt from a material web carrying side to an opposite side.

19. A method for drying a material web within a dryer group of a web producing machine, the dryer group including a first and second subgroup, each subgroup including a plurality of dryer cylinders and an associated dryer belt that guides the material web around the plurality of dryer cylinders within the associated subgroup, and a tranfer region located between the first and second subgroup, the method comprising:

guiding the material web, in free draw, alternatingly between dryer cylinders of the first subgroup and dryer cylinders of the second subgroup;

substantially preventing drying of the material web as the material web is guided between the first and second subgroups;

drying the dryer belt associated with the first subgroup by forcing air through the dryer belt; and drying the dryer belt associated with the second subgroup by forcing air through the dryer belt.

20. The method according to claim 19, the substantially preventing drying comprising maintaining a moisture content within the transfer region to substantially similar to the moisture content of the material web within the transfer region.

21. The method according to claim 19, the drying the dryer belt associated with the first subgroup comprising:

locating a suction box adjacent a return portion of the dryer belt between an end of the first subgroup and a beginning of the first subgroup;

guiding the dryer belt of the first subgroup through a suction region of the suction box; and drawing moisture through the dryer belt of the first subgroup from a material web contacting side to an opposite side.

22. The method according to claim 19, the drying the dryer belt associated with the second subgroup comprising:

locating a blower box adjacent a return portion of the dryer belt between an end of the second subgroup and a beginning of the second subgroup;

guiding the dryer belt of the second subgroup through a blower region of the blower box; and forcing moisture through the dryer belt of the second subgroup from a material web contacting side to an opposite side.

23. The method according to claim 22, the forcing moisture comprising:

directing the air and moisture into an interior portion of the second subgroup; and aspirating the directed air and moisture from the interior portion of the second subgroup.

24. The method according to claim 19, the drying the dryer belt associated with the first subgroup comprising:

locating a belt drying device within the first subgroup;

diverting the dryer belt associated with the first subgroup away from a predetermined dryer cylinder of the first subgroup to a position within the first subgroup;

guiding the dryer belt of the first subgroup to the belt drying device; and removing moisture from dryer belt of the first subgroup from a material web contacting side to an opposite side.

25. The method according to claim 24, the belt drying device comprising a blower box and a suction box;

guiding the dryer belt between the blower box and the suction box; and concurrently forcing air through the dryer belt and suctioning air through the dryer belt.

* * * * *